United States Patent [19]

Hemmings

[11] Patent Number: 4,598,822

[45] Date of Patent: Jul. 8, 1986

[54] DRILL BIT CARRYING CASE

[75] Inventor: David T. Hemmings, Orange, Calif.

[73] Assignee: Megatool Inc., Buena Park, Calif.

[21] Appl. No.: 703,220

[22] Filed: Feb. 19, 1985

[51] Int. Cl.[4] ..... B65D 85/24

[52] U.S. Cl. ..... 206/379; 206/472; 206/475; 206/805

[58] Field of Search ..... 206/366, 379, 371, 380, 206/381, 472, 473, 475, 805; 211/69, 70.6, 70.7

[56] References Cited

U.S. PATENT DOCUMENTS

| | | | |
|---|---|---|---|
| 393,432 | 11/1888 | Hebbard | 206/472 |
| 683,629 | 10/1901 | Webster | 206/100 |
| 776,402 | 11/1904 | Johnson | 206/366 |
| 1,889,966 | 12/1932 | Whitehead | 206/526 |
| 3,426,890 | 2/1969 | Bayer | 206/379 |
| 3,494,458 | 2/1970 | Meierhoefer | 206/366 |
| 4,496,048 | 1/1985 | Sykes | 206/472 |

FOREIGN PATENT DOCUMENTS

| | | | |
|---|---|---|---|
| 2446504 | 2/1976 | Fed. Rep. of Germany | 206/379 |
| 1222240 | 1/1960 | France | 206/379 |
| 271732 | 6/1927 | United Kingdom | 206/805 |
| 2124186 | 2/1984 | United Kingdom | 206/379 |

*Primary Examiner*—Stephen P. Garbe
*Assistant Examiner*—Brenda J. Ehrhardt
*Attorney, Agent, or Firm*—William L. Chapin

[57] ABSTRACT

A carrying case for drill bits has concave rectangular top and bottom panels pivotably mounted at their rear long edges to a narrow, rectangular hinge strip and fastenable at the front edges of the panel to form a closed box. A drill bit holding block extending inward from the inner surface of the hinge strip contains a plurality of parallel bores disposed perpendicularly downward from the flat upper surface of the block. A longitudinally disposed slot cut through the rear surface of the block communicates with each bore. An elastic band looped around the block and lying in the slot is deformable by a longitudinally disposed, grooved compression strip extending inward from the top panel of the case to apply compressive holding forces on the shanks of drills contained within the bores in the holding block, thereby securing the drills in position with the box closed.

2 Claims, 7 Drawing Figures

DRILL BIT CARRYING CASE

BACKGROUND OF THE INVENTION

1. Field of the Invention

This invention relates to protective carrying cases for drill bits. More particularly, the invention relates to cases adapted to holding a number of drill bits in a secure manner to protect the drill bits against damage during transportation or storage.

2. Description of Background Art

Drill bits, or "drills" as they are referred to by many of their industrial users, are employed in a wide range of manufacturing industries. One particular industry which uses drills very extensively is the printed circuit board manufacturing industry.

Printed circuit boards are used in an extremely wide variety of electronic and electrical equipment in the consumer, commercial, industrial and military markets. To a large extent, planar conductors on the surfaces of printed circuit boards have replaced wires which were formerly used to interconnect different points in an electrical or electronic circuit. Typically, the first step in manufacturing printed circuit boards is to adhere a copper sheet onto one or both sides of a thin, flat "board" made of insulating plastic or fibreglass. Holes are then drilled through the board as is explained below. The copper sheet is then coated with a light-sensitive emulsion. Next, a photographic negative defining desired conductive paths is placed in contact with the emulsion coated copper sheet, and the whole exposed to light. This process results in a physical change in the emulsion, making it acid resistant where conductive paths have been delineated by differing amounts of light received through the negative. When the exposed board is subsequently dipped in an acidic etching bath, those portions of the copper sheet other than the conductive paths are selectively etched away, leaving a pattern of conductive paths consisting of thin strips of copper sheet adhered to the surface of the board.

As was mentioned above, holes must be drilled through the printed circuit board at the end of each conductive path. The holes are adapted to receive the wire leads from electronic components such as resistors, capacitors, transistors and the like, which are to be mounted to the board. At least two separate holes are required for each electronic component to be mounted on the printed circuit board. Each printed circuit board may have dozens or hundreds of components. Also, electronic components such as integrated circuits may have up to several dozen leads, each requiring a hole in the printed circuit board. Therefore, manufacture of printed circuit boards typically requires the drilling of several hundred or a thousand or more holes of a variety of sizes in just a single printed circuit board.

Every printed circuit board has at least one layer of copper sheet and one layer of insulating board material which must be penetrated during drilling. Frequently, the insulating board material is fibreglass-reinforced epoxy. Since those materials which printed circuit board drills must penetrate are typically hard and abrasive, the drills used must be very hard to ensure an acceptably long life for the drills. Accordingly, most printed circuit drills are tipped with tungsten carbide, which is one of the hardest and most wear resistant materials available for industrial use.

Generally, materials which are very hard are inherently brittle. This is true of tungsten carbide, with the harder grades being more brittle than softer grades. Printed circuit board (PCB) drills, then, which are tipped with tungsten carbide, are readily susceptible to chipping and breaking of the cutting edges of the drill if not handled carefully.

Typically, PCB drills are fitted with an annular collar interference fitted on the shank of the drill a measured distance from the point. Contact of the collar with the drill machine collet, controls the depth of drill penetration. Now since PCB drills are used to penetrate highly abrasive materials, the drills wear rapidly inspite of the extremely hard materials used on their cutting edges. For that reason, PCB drills are repointed up to three or more times before they are finally discarded. To be repointed, the drills must be removed from drill spindles, and transported to a repointing machine. Many of the repointing machines require removal of the annular shank rings before they can be repointed. This necessitates separate removal and replacement steps in conjunction with the repointing operations. When worn drills are placed helter skelter in a box for transport to a repointing machine, chipping of contacting drills often occurs.

Because of the potential for damage which can occur to PCB drills during transport, a variety of protective carrying cases intended to minimize damage to the drills have been devised.

One type of carrying case presently used has a block of resilient material such as styrofoam containing a plurality of parallel cylindrical holes. The diameter of the holes in the styrofoam are slightly smaller than the shank diameters of drills which the block is intended to accommodate. Thus, drills which are inserted shank-first into the holes are held in place by an interference fit. A disadvantage of this type of drill carrying case is that it is difficult to selectively remove a drill from the box without striking and thereby damaging an adjacent drill. Further, this type of packaging does not allow all the drill points to settle at the same height; incoming drill bit inspection is therefore difficult.

A second type drill carrying case consists of a plastic tube and end cap. With this method, drills are packaged individually.

Another type of package consists of a vacuum formed pack with cavities that approximate the shape of the drill. Each cavity accommodates 1 drill.

A third type of drill carrying case in current use has the general external shape of a thin, flat, rectangular box. The top and bottom of the box are hinged at the back, and the facing front edges of the box provided with a fastener which may be readily joined and separated. When unfastened, the top of the box is foldable backwards, placing both top and bottom of the box in a common horizontal plane. Extending perpendicularly upward from the inner surface of the back hinged surface of the box is a thin holding block spanning nearly the full width of the box. The holding block contains a plurality (twelve or so) of parallel blind holes adapted to loosely hold the shanks of drills. Foam rubber strips fastened to inner facing surfaces of the top and bottom panels of the box span the width of the box. When the top and bottom panels of the box are snapped together, compressive pressure of the resilient foam rubber strips upon the drills holds them in place. A disadvantage of this type of drill carrying case is the limited range of drill sizes which may be carried in a given case. The practical limit in this range is from about #97 drills (0.0059 inch) to $\frac{1}{8}''$ diameter drills. To accommodate drills from $\frac{1}{8}''$ to $\frac{1}{4}''$, excessively thick foam rubber strips would be required. If the smaller thickness strips, adequate for use with smaller diameter drills were used with the larger size range drills, the excessive percentage of foam thickness depression caused by the larger diameter drills would destroy the elastic memory of the foam strips.

The present invention was conceived of to overcome some of the disadvantages of existing drill carrying cases.

OBJECTS OF THE INVENTION

An object of the present invention is to provide a carrying case for drill bits which protects the cutting surfaces of the drills from damage.

Another object of the invention is to provide a drill carrying case which will securely hold a number of drills of various diameters.

Another object of the invention is to provide a drill carrying case which can securely hold drills with and without attached depth-control rings.

Various other objects and advantages of the present invention, and its most novel features, will become apparent to those skilled in the art by reading the accompanying specification.

It is to be understood that although the invention disclosed herein is fully capable of achieving the objects and providing the advantages mentioned, the characteristics of the invention described herein are merely illustrative of the preferred embodiment. Accordingly, I do not intend the scope of my exclusive rights and privileges in the invention to be limited to the details of the embodiments described. I do intend that reasonable equivalents, adaptations and modifications of the invention described herein be included within the scope of this invention as defined by the appended claims.

SUMMARY OF THE INVENTION

Briefly stated, the present invention comprehends a carrying case for transporting a number of twist drill bits, while protecting the drills from damage resulting from contact between one drill and another, or between a drill and an external object. In its basic embodiment, the carrying case according to the present invention has the general outward appearance of a thin, flat box having rectangular shaped top and bottom panels. The top and bottom panels of the box are connected along a long edge by a hinged back strip. Mating fasteners on adjacent edges of flanges extending perpendicularly inward along the front edges of the top and bottom panels of the box are readily engageable and disengageable to close and open the box, respectively.

With the front edge flanges of the box disengaged, the top and bottom panels of the box are pivotable away from each other along the hinged back strip. This affords access to an elongated, rectangular drill holding block which extends perpendicularly inward from the inner surface of the hinged back strip of the box. The drill holding block, which spans a substantial portion of the width of the box, contains a plurality of parallel holes disposed perpendicularly inward from the flat upper surface of the block. These holes are adapted to loosely hold the shanks of drills inserted shank-first into the holes.

A narrow rectangular slot cut through the rear vertical surface of the drill holding block penetrates approximately to the longitudinal midplane of the block, and is disposed parallel to the top surface of the block. The slot spans nearly the entire length of the block, terminating equal distances from either end of the block. The width of the slot, which communicates with each drill holder hole, is adapted to receive a narrow elastic band which may be looped around the block.

On the inner, flat surface of either the top or bottom panel of the box, an elongated compressor strip extends upward from the panel surface and spans the width of the box, adjacent to the slot in rear surface of the holding block, when the box is closed. The compressor strip has a flat upper surface, and a plurality of semicircular cross section grooves cut into the upper surface transverse to the long dimension of the compressor strip. The direction of each of the grooves is coaxial with each drill holder hole which the groove is adjacent to when the box is closed. When the box is closed, the flat, uncut portions of the upper surface of the compressor rib compressively contact those portions of the elastic band retained in the slot in the drill holder block which lie between drill shanks. This produces tension in the band, resulting in a compressive force being exerted on the shank of any drills inserted into the drill holder holes. The compressive force securely retains the drills in place in the drill holder holes when the top and bottom panels of the box are in a parallel, closed position.

DESCRIPTION OF THE PREFERRED EMBODIMENT

Figure 1:
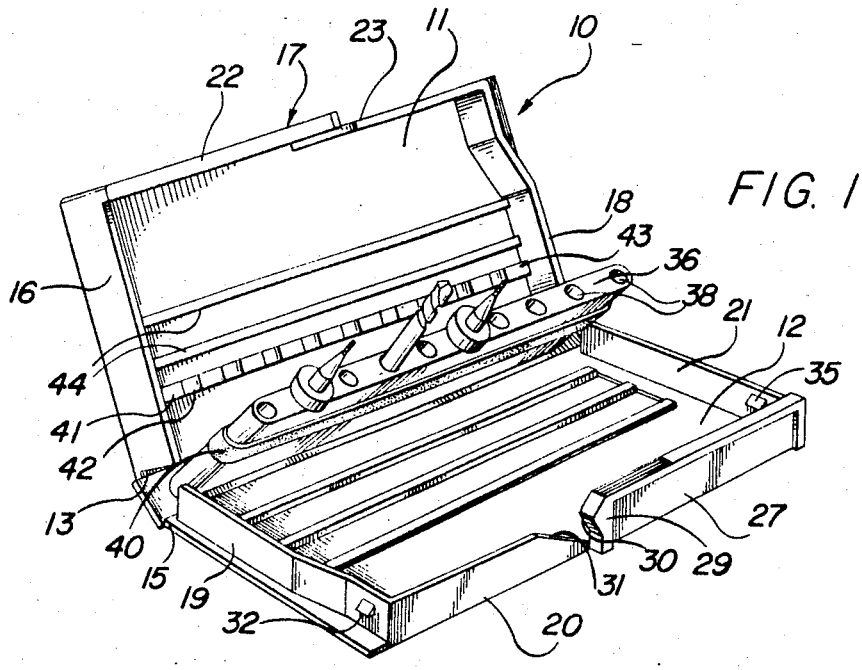
FIG. 1 is an upper perspective view of the drill carrying case according to the present invention, with the case open.

Referring now to FIG. 1, a perspective view showing a drill carrying case according to the present invention an open position is presented. As shown in FIG. 1, carrying case 10 has the general appearance of a thin, flat box having a rectangular lid panel 11 and a matching base panel 12. The rear long edge 13 of panel 11 is joined to the top edge of an elongated strip of material comprising the back panel 14 of the box. Similarly, the rear long edge 15 of base panel 12 is joined to the lower edge of back panel 14. Preferably, lid panel 11, base panel 12 and back panel 14 are injection molded from a single piece of thermoplastic material such as polypropylene. When so fabricated, the joints at edges 13 and 15 may be thinner than the thickness of the lid panel 11 and base panel 12. The reduced thickness of the joints between either lid or base panel and the back panel permits either or both lid and base panels to pivot freely around the longitudinal center line of the joint. The reduced thickness joints thus may function as "live" i.e. integral, hinges.

As shown in FIG. 1, lid panel 11 and base panel 12 both have a plurality of flanges which project perpendicularly inward from the inner surfaces of the panels. Lid panel 11 has a left side flange 16 fastened to the left edge of the panel, a front flange 17 fastened to the front edge, and a right flange 18 fastened to the right edge. Similarly, base panel 12 has a left side flange 19 fastened to the left edge of the panel, at front flange 20 fastened to the front edge, and a right flange 21 fastened to the right edge.

Means for fastening together the base and lid of carrying case 10 are incorporated into the front flanges of the base and lid, as will now be described. As may be seen best in FIGS. 1 and 3, front lid panel flange 17 is comprised of two segments. A left flange segment 22 has the general appearance of an elongated, rectangular cross section bar which extends parallel to the back panel of the box and perpendicularly from the left side of the box lid to a point slightly beyond the mid point of the box. A right flange segment 23 located rearward of the rear plane of left flange segment 22 has a similar shape, and extends parallel to and closer to the back panel of the box, perpendicularly from the right side of the box lid to a point slightly beyond the mid point of the box. The front surface of right flange segment 23 lies slightly behind the plane defined by the rear surface of left flange segment 22.

Extending rightward from the right face of left lid panel flange segment 22 is a boss 24 having in plan view a triangular cross-sectional shape. The vertex 25 of boss 24 extends just slightly beyond the vertical longitudinal center plane of the box.

The left face 26 of right front lid panel flange segment 23 slopes upward from the lower edge of the segment, beginning at a point slightly to the right of the vertical longitudinal center plane of the box, to join the lower surface of lid panel 11 behind and to the left of boss 24.

Front base panel flange 20 is comprised of two segments exactly analogous to the two segments of the front lid panel flange 17 just described, but reversed in position between right and left sides. Thus, as shown in FIG. 1, front base panel flange 20 is comprised of a right half segment 27 similar in shape to left front lid panel flange segment 22, and a left half segment 28 similar in shape to right front lid panel flange segment 23. Similarly, right front base panel flange segment 27 has a triangular boss 29 protruding leftward from the left face of the flange segment, and a vertex 30 terminating boss 29. Also, the right face 31 of left front base panel flange segment 28 slopes downward from the upper edge of the segment, beginning at a point slightly to the left of the vertical longitudinal center plane of the box, to join the upper surface of base panel 12 behind and to the right of boss 29.

Figure 3:
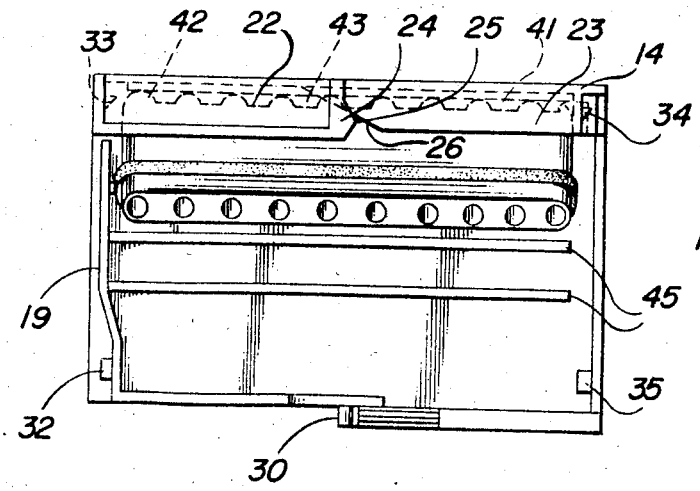
FIG. 3 is a front elevation view of the article of FIG. 1, in a partially opened position.
Figure 4:
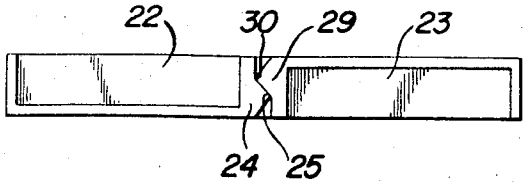
FIG. 4 is a front elevation view of the article of FIG. 1 in a closed position.

The structural features of front lid panel flange 17 and front base panel flange 20 cooperate to provide efficient means for securely closing and readily opening carrying case 10, as will now be described. Referring now to FIGS. 3 and 4, it may be seen that vertex 25 of boss 24 of left front lid panel flange segment 22 protrudes slightly to the right of the longitudinal vertical center plane of case 10. Similarly, vertex 30 of boss 29 of right front base panel flange segment 27 protrudes slightly to the left of the longitudinal vertical center plane of case 10. When lid panel 11 is pivoted downwards towards base panel 11, the lower face of triangular boss 24 tangentially contacts the upper face of triangular boss 29. When lid and base panels are squeezed forcibly together, the inclined contact plane between the sloping faces of the bosses produces a force tending to displace the vertices of the bosses away from the center vertical longitudinal plane of the case. The flexibility of the plastic material from which the case is fabricated permits the bosses to be displaced outward from the center plane as the base and lid of the case are squeezed together. As base and lid become closer, the vertices of the bosses finally contact one another. At this point, squeezing the lid and base slightly closer together causes lower vertex 30 to move above upper vertex 25. The elasticity of case 10 then causes the sides of the case to move inwards towards the undistorted position. Sliding contact between the outer faces of the bosses permit the sides to move together with a minimum of frictional resistance.

Additional means for fastening together the base and lid of case 10 are incorporated into the side flanges of the base and lid, as will now be described.

As may be seen best by referring to FIGS. 1 and 3, the outer surface of left side base panel flange 19 is displaced inwards from the inner surface of left side lid panel flange 16, permitting the flanges to slide by each other without interfering contact when lid panel 11 and base panel 12 are pivoted towards one another to close case 10. As shown in the Figures, the front portion of left side base panel flange 19 is displaced inwards towards the longitudinal vertical center plane of the box from its position towards the rear of box. A wedge-shaped boss 32 protrudes perpendicularly outward from the outer surface of the left side base panel flange 29, close to the intersection between the side base panel flange and front base panel flange 20. Because of the inward displacement of that portion of left side base panel flange 19 from which boss 32 protrudes, the outer surface of the boss is displaced inwards from the vertical pivot plane of the inner surface of left side lid panel flange 16.

A matching boss 33 protrudes perpendicularly inwards from the inner surface of left side lid panel flange 16, the same distance forward from back panel 14 as boss 32. When lid panel 11 and base panel 12 are pivoted towards one another, the inclined contact plane between the sloping faces of bosses 32 and 33 permits the bosses to slide vertically and laterally in relationship to one another, until the two vertices of the bosses transit each other in a vertical direction. At this point the flat lower surface of lower boss 32 and the flat upper surfaces of upper boss 33 are in locking contact, holding the left sides of lid panel 11 and base panel 12 firmly together.

In an exactly analogous way, the front portion of upper right lid panel flange 18 is displaced inwards, and contains outward protruding boss 34. Also, right side base panel flange 21 has an inwardly protruding boss 35. Right side bosses 34 and 35 slide over one another into locking engagement when the right sides of lid panel 11 and base panel 12 are squeezed together, exactly as has been described for left side bosses 32 and 33.

Figure 5:
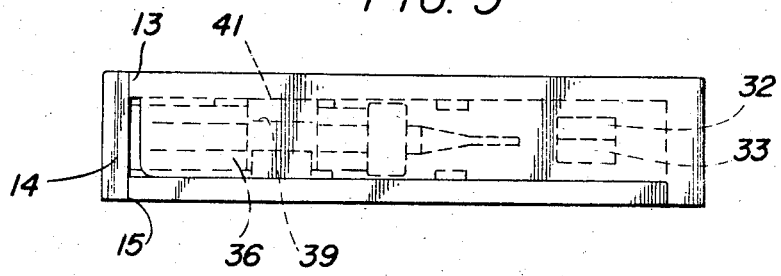
FIG. 5 is a side elevation view of the article of FIG. 1.

The three fastening means previously described cooperate to keep the middle, left and right sides of lid panel 11 and base panel 12 fastened securely together. Therefore, these fastening means are effective in sealing the entire contact perimeter of base panel and lid panel, as shown in FIGS. 4 and 5.

Figure 6:
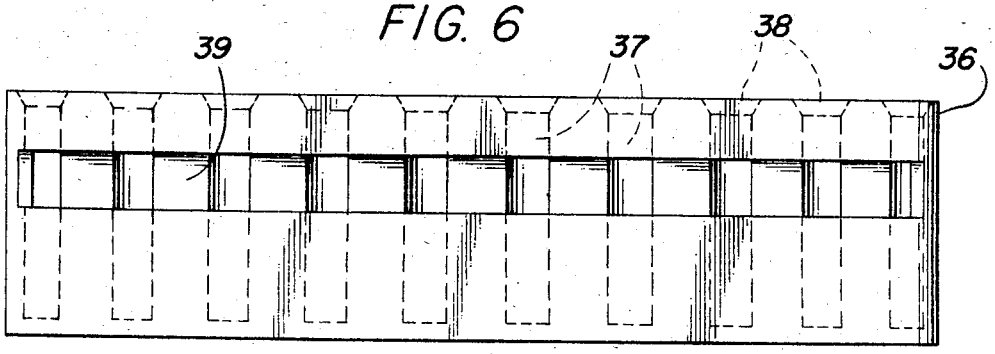
FIG. 6 is a partially sectional front elevation view of the article of FIG. 1, shown in an open position.
Figure 7:
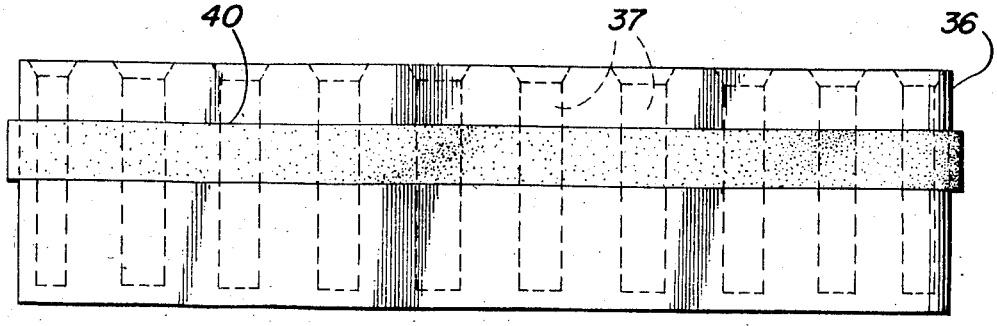
FIG. 7 is a partially sectional rear elevation view of the article of FIG. 1, in an opened position.

As may be seen best by referring to FIGS. 1 and 6, an elongated block 36 extends perpendicularly inwards from the inner surface of back panel 14. Block 36 has a generally rectangular bar shape, and spans nearly the full width of case 10 from points equidistant from the inner surfaces of left side base panel flange 19 and right side lid panel flange 18.

Block 36 contains a plurality of parallel cylindrical holes 38 disposed inward from holes 38 in the flat upper surface of the block. Bores 37 are adapted to loosely hold shanks of drills which may be inserted shank first into bores 37.

As may be seen best by referring to FIG. 6, a narrow rectangular slot 39 cut through the rear vertical surface of block 36 penetrates approximately to the transverse mid plane of the block, and is disposed parallel to the top surface of the block and to the top and bottom surfaces of back panel 14. Slot 39 spans nearly the entire width of block 36, terminating equal distances from either end of the block. The vertical width of slot 39, which communicates with each cylindrical bore 37, is of such a dimension as to be adapted to receive a narrow elastic band 40 which may be looped around block 36, as shown in FIG. 1.

Figure 2:
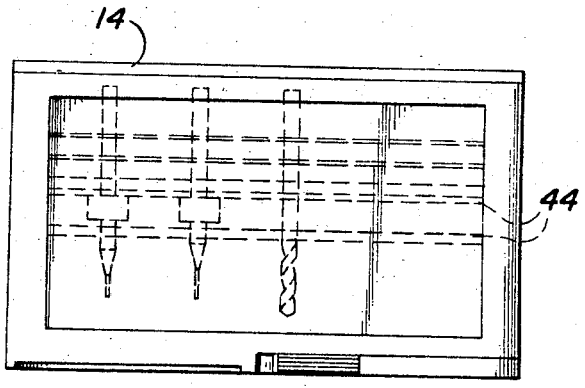
FIG. 2 is a top plan view of the article of FIG. 1 in a closed position.

As may be seen best by referring to FIGS. 1 and 2, a narrow elongated compressor rib 41 having a vertical width slightly less than the vertical width of slot 39 in drill holder block 36 extends inward from the inner surface of lid panel 11. Compressor rib 41 spans the width of slot 39, and lies adjacent to the slot when case 10 is closed, as shown in FIG. 2.

Compressor rib 41 has a flat upper surface, and contains a plurality of semicircular cross section grooves 42 cut into the upper surface transverse to the long dimension of the rib. The directrix, or cylindrical axis, of each of the grooves 42 is approximately coaxial with the respective drill holder bore 37 to which the groove is adjacent with the case 10 in a closed position. When case 10 is closed, the flat, uncut portions 43 on the upper surface of compressor rib 41 compressively contact those portions of elastic band 40 in slot 39 which span the distance between adjacent drill holder bores 37. This compressive pressure produces tension in band 40, resulting in an inward compressive force being exerted on the shank of any drills occupying bores 37. When case 10 is closed by snapping lid panel 11 and base panel 12 together, the compressive force exerted by band 40 on the shanks of drills of various diameters which have been inserted into bores 37 secures the drills against longitudinal movement out from the bores. When case 10 is opened, the compressive force on the shanks of drills in bores 37 is relieved, permitting the drills to be easily withdrawn.

As may be seen best by referring again to FIGS. 1 and 2, case 10 incorporates additional elements adapted to securing drills fitted with annular depth control rings. As shown in the Figures, a pair of rectangular transverse cross-section retainer ribs 44 protrudes inward from the inner surface of lid panel 11. Retainer ribs 44 are disposed parallel to compressor rib 41 to separate distances closer to front lid panel flange 17 than rib 41. The positioning of retainer ribs 44 is such as to longitudinally encompass the thickness of an annular depth control ring mounted onto a drill inserted into a bore 37 when case 10 is closed. This spaced relationship between a drill depth control ring and ribs 44 may be appreciated by referring to FIG. 2.

As shown in the Figure, a pair of retainer ribs 45 identical in shape and position and disposition to lid retainer ribs 44 protrudes inward from the inner surface of base panel 12. Thus with case 10 closed, the lower portions of annual depth control rings on drills contained in bores 37 of drill holder block 36 are retained by base retainer ribs 45 in the same way as the upper portions are retained by lid retainer ribs 44. Retainer ribs 44 and 45 therefore ensure that drills fitted with annular depth control rings will be retained securely in place in bores 37 even in the absence of elastic band 40.

What is claimed is:

1. A carrying case for drill bits comprising:

a. a rectangular lid panel having generally flat, parallel upper and lower surfaces, and thin rectangular flanges projecting downward from the long front edge and shorter side edges of the said lid panel, b. a rectangular base panel having generally flat, parallel upper and lower surfaces, and thin rectangular flanges projecting upward from the long front edge and shorter side edges of said base panel, c. an elongated rectangular back panel pivotably fastened on a long upper edge of said back panel to the rear edge of said lid panel, and pivotably fastened on a long lower edge of said back panel to the rear edge of said base panel, d. an elongated drill holder block extending perpendicularly outward from the inner surface of said back panel, said drill holder spanning a substantial portion of the length of said back panel and containing a plurality of parallel cylindrical bores extending downward from the flat upper surface of said block, e. fastening means for securing the said lid panel and said base panel in parallel alignment, with said lid panel flanges and said base panel flanges overlapping to cooperate with said lid panel, said base panel and said back panel to form a rectangular closed box, and f. means responsive to said pivotal motion between said drill holder block and at least one of said lid panel and said base panel in securing drills inserted into said drill holder block bores against longitudinal movement out of said bores, said drill securing means comprising in combination an aperture in a vertical face of said drill holder block communicating with said bores, and a projecting member projecting inward from the surface of an adjacent closure panel effective in exerting compressive pressure on the shanks of drills inserted into said drill holder block.

2. The article of claim 1 wherein said drill securing means comprises in combination:

a. a narrow slot cut through the rear surface of said drill holder block, said slot symmetrically spanning nearly the full width of said block and communicating with said bores in said block, b. an elastic loop encompassing said block and lying conformally in said slot, and c. an elongated rib protruding perpendicularly inward from an inner surface of said adjacent closure panel effective in exerting compressive forces on portions of said elastic band spanning the distances between adjacent said bores.

* * * * *